United States Patent [19]

Verweel

[11] 4,339,688

[45] Jul. 13, 1982

[54] CATHODE-RAY TUBE HAVING A MAGNETIC QUADRUPOLE SHADOW MASK

[75] Inventor: Jan Verweel, Eindhoven, Netherlands

[73] Assignee: U.S. Philips Corporation, New York, N.Y.

[21] Appl. No.: 135,801

[22] Filed: Mar. 31, 1980

[30] Foreign Application Priority Data

May 3, 1979 [NL] Netherlands ..... 7903467

[51] Int. Cl.[3] ..... H01J 29/07; H01J 31/20

[52] U.S. Cl. ..... 313/403; 313/408

[58] Field of Search ..... 313/402, 403, 408, 442, 313/443

[56] References Cited

U.S. PATENT DOCUMENTS 4,135,111 1/1979 Verweel ..... 313/403

*Primary Examiner*—Eli Lieberman

*Attorney, Agent, or Firm*—Robert J. Kraus

[57] ABSTRACT

A cathode ray tube for displaying colored pictures of the post-focusing type. The color selection means are formed by a plate which is provided with a large number of apertures, which plate is provided on one side with a first plate of parallel strips of hard magnetic material provided between the rows of apertures. The color selection means are magnetized in a direction perpendicular to the plane of the plate so that a magnetic quadrupole is obtained in each aperture.

3 Claims, 10 Drawing Figures

CATHODE-RAY TUBE HAVING A MAGNETIC QUADRUPOLE SHADOW MASK

BACKGROUND OF THE INVENTION

The invention relates to a cathode ray tube for displaying coloured pictures comprising in an evacuated envelope means to generate a number of electron beams, a display screen comprising a large number of areas luminescing in different colours, and colour selection means comprising a large number of apertures, in which apertures a magnetic quadrupole lens is formed, and which apertures assign each electron beam to luminescent areas of one colour.

Such a cathode ray tube of the post-focusing type is disclosed in Netherlands Patent Application No. 7515039. The object of post-focusing is to increase the brightness of the displayed picture by increasing the transmission of the colour selection means. In tubes without post-focusing a very large part, for example 80 to 85%, of the electrons is intercepted by the so-called shadow mask. By using post-focusing, the apertures in the colour selection means can be enlarged since as a result of the focusing in the apertures the electron spots on the screen are considerably smaller than the apertures so that nevertheless sufficient space is present between the electron spots of the various electron beams.

In the known cathode ray tube of the post-focusing type a magnetic quadrupole lens is formed in each aperture of the colour selection means. In these quadrupole lenses the magnetic field is substantially perpendicular to the electron paths and the electron beams are focused in one direction and are defocused in a direction perpendicular thereto. According to an example of the known tube the colour selection means are formed by a grid of two sets of parallel strips of soft magnetic material which cross each other and which are interconnected at the crossings by means of slices of hard magnetic material. The slices are magnetized in a direction perpendicular to the grid. The positioning of the individual slices of hard magnetic material at the crossings of the grids of strips of soft magnetic material, however, is a cumbersome method for the manufacture of large numbers of tubes. According to another embodiment the colour selection means are formed by a ferromagnetic plate or a non-ferromagnetic plate having a layer of magnetizable material in which around each aperture a magnetic quadrupole is written by means of a writing head. In addition the colour selection means must be provided with extra means to screen the electron beams from the earth's magnetic field because a ferromagnetic plate which is permanently magnetized does not screen the earth's magnetic field.

SUMMARY OF THE INVENTION

It is therefore the object of the invention to provide a cathode ray tube with magnetic post-focusing in which the colour selection means are of a simple construction and of which in particular the magnetization can take place in a simple manner.

According to the invention a cathode ray tube of the kind mentioned in the opening paragraph is characterized in that the colour selection means are formed by an apertured plate of a soft-magnetic material, which plate is provided on one side with a first grid of parallel strips of hard magnetic material provided between the rows of apertures and which colour selection means are magnetized in a direction perpendicular to the plane of the plate.

The strips are of a hard-magnetic material, which means that the strips show permanent magnetism after having been magnetized by an external magnetic field, whereas the plate of soft magnetic material shows substantially no permanent magnetism. By magnetizing the plate with strips in a direction perpendicular to the plate, the sides of the strips remote from the plate serve, for example, as north poles and the plate serves as a south pole. In this manner, a magnetic quadrupole is formed in each aperture. The plate can be manufactured in a simple manner from a rollable material in which the apertures have been etched in a manner which is used in the nowadays conventional shadow masks. The strips of hard magnetic material can be secured to the plate, for example, by means of a vitreous material.

A second embodiment of a cathode ray tube in accordance with the invention is characterized in that on the side remote from the first grid the plate of soft magnetic material is provided with a second grid of parallel strips of hard magnetic material, the strips of the second grid crossing the strips of the first grid.

A magnetic quadrupole is formed on each side of each aperture the focusing and defocusing effect of which are directed in the same direction. The sides of the strips of the first grid remote from the plate in this construction constitute north poles and the sides of the strips of the second grid remote from the plate constitute south poles. As a result of this, a magnetic quadrupole lens is formed in each aperture on either side of the plate. The result of this is that imperfectnesses of the shape of the spot of the electron beam on the display screen after passing through the first quadrupole lens as a result of differences in the strength of the poles of the first quadrupole are partly corrected by the second quadrupole lens.

Another embodiment of a cathode ray tube in accordance with the invention is characterized in that the strips of hard magnetic material are provided with a layer of soft magnetic material on the side remote from the plate. The advantage of this is an intensified focusing effect which moreover results in a better screening of the electron beams from the earth's magnetic field in the tube than in the case in which only the plate of soft magnetic material produces the magnetic screening.

BRIEF DESCRIPTION OF THE DRAWING

The invention will now be described in greater detail with reference to the accompanying drawing, of which

DESCRIPTION OF THE PREFERRED EMBODIMENTS

Figure 1:
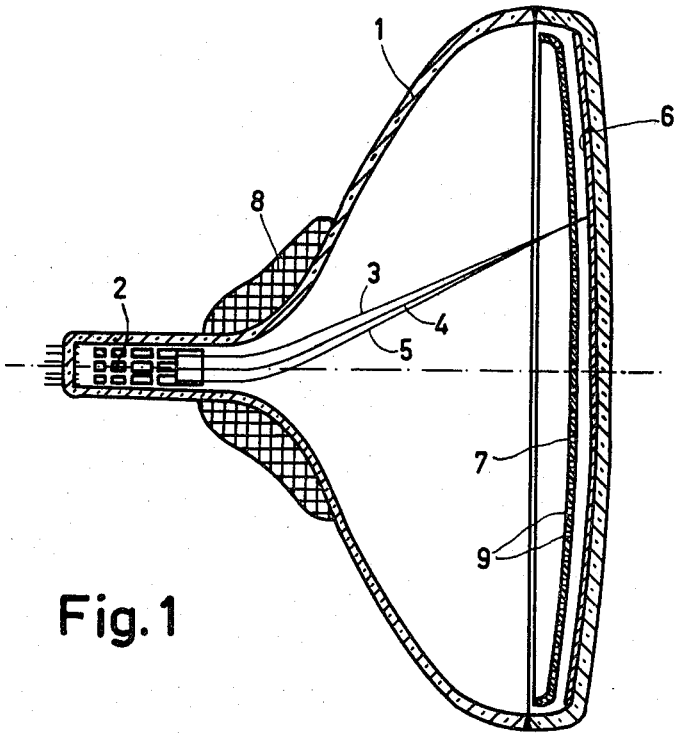
FIG. 1 is a sectional view of a cathode ray tube for displaying colour pictures according to the invention, FIGS. 2 and 3 explain the principle of the focusing effect of a magnetic quadrupole.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected on the display screen 6 by means of the deflection coils 8. The display screen 6 consists of a large number of phosphor strips luminescing in red, green and blue and the longitudinal direction of which is perpendicular to the plane of the drawing of FIG. 1. In normal operation of the tube the phosphor strips are vertical and FIG. 1 thus represents a horizontal cross-section of the tube. The colour selection means 7 which will be described in greater detail with reference to FIGS. 3, 4 and 5, comprise a large number of apertures 9 which are shown diagrammatically only in FIG. 1. The three electron beams 3, 4 and 5 pass through the apertures 9 at a small angle with each other and consequently each impinge only on phosphor strips of one colour. The apertures 9 in the colour selection means 7 are thus very accurately positioned relative to the phosphor strips of the display screen 6.

Figure 2:
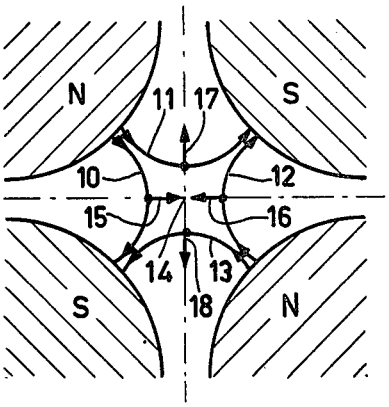

The known principle of a magnetic quadrupole lens will be illustrated again with reference to FIG. 2. Four magnetic poles which are magnetized cyclically north-south-north-south (N—S—N—S) constitute a magnetic field of which a few field lines are denoted by 10, 11, 12 and 13. An electron beam the axis of which coincides with the axis 14 of the quadrupole lens and the electrons of which move backwards perpendicular to the plane of the drawing, experiences the focusing and defocusing forces denoted by the arrows 15, 16, 17 and 18. So the cross-section of the electron beam is extended in the vertical direction and is made narrower in the horizontal direction.

Figure 3:
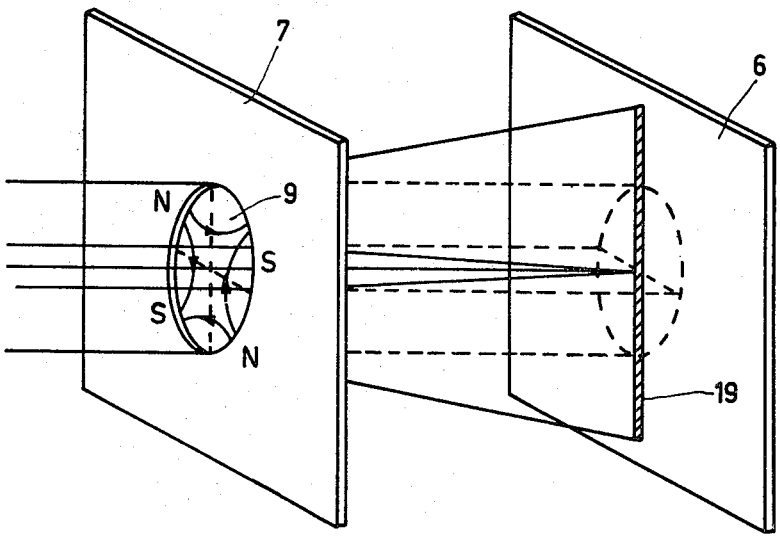

FIG. 3 shows diagrammatically such a magnetic quadrupole lens in an aperture 9 of the colour selection means 7. The variation of the magnetization along the edge of the aperture 9 is denoted by N,S, N, S in such manner that a quadrupole field is formed. The electron beam which passes through the aperture 9 is focused in the horizontally drawn plane and defocused in the vertically drawn plane, so that, when the display screen is present exactly in the horizontal focusing point, the electron spot 19 is formed. In order to prevent a so-called focusing ring it is recommendable not to focus exactly on the display screen 6 so that a slightly wider electron spot is formed. It is only of minor influence on the focusing when the electron beam passes through the aperture 9 at a small angle; as a result of this the colour selection of the three electron beams 3, 4 and 5 takes place in an entirely analogous manner as in the nowadays generally used shadow mask tube in which the electron beams are not focused when passing through the apertures in the shadow mask. However, due to the strong focusing the aperture 9 may be much larger than in the known shadow mask tube so that much more electrons impinge on the display screen 6 and a brighter picture is obtained. The defocusing in the vertical direction need not be a disadvantage when phosphor strips are used which are parallel to the longitudinal direction of the spot 19.

The colour selection means of the tube according to the invention shown in FIG. 1 will now be described with reference to FIG. 4*a*. The colour selection means 7 are formed by a plate 20 of a soft magnetic material in which a large number of apertures 9 are provided. A soft magnetic material has the property of showing substantially no permanent magnetism after having been magnetized by an external field. A soft magnetic material also provides a good screening from the earth's magnetic field. The plate 20 is, for example, of iron in which apertures 9 have been etched. A grid of parallel strips 21 situated between the apertures is provided on one side of the plate by means of, for example, a vitreous material. The strips 21 are of a hard magnetic material, which means a material which shows a very strong permanent magnetism after having been magnetized by an external magnetic field. The strips 21 are manufactured, for example, from a material obtainable by the trade name "Ferroxdure". The strips 21 are preferably provided on the plate 20 in the unmagnetized condition after which they are magnetized simultaneously by means of a homogeneous magnetic field perpendicular to the plane of the colour selection means 7. If the direction of the magnetic field is equal to the direction of the arrow 22, the sides of the strips 21 remote from the plate 20 constitute north poles, the plate 20 serving as a south pole. In this manner a magnetic quadrupole is formed in each aperture 9 of the plate 20.

Figure 4A:
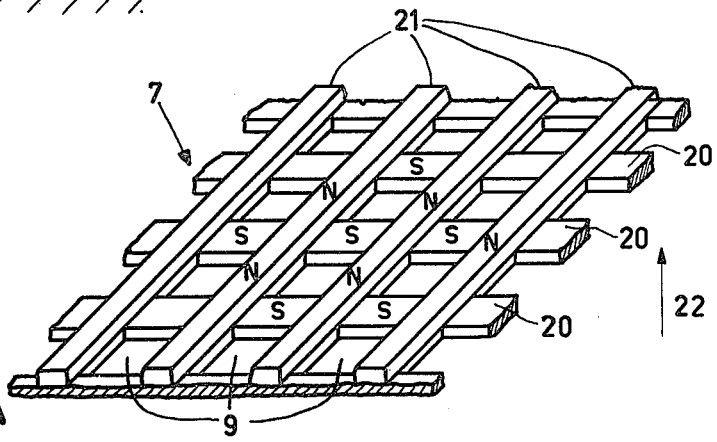
FIGS. 4A, 4B, 4C and 4D show an embodiment of the colour selection means of a tube according to the invention.
Figure 4B:
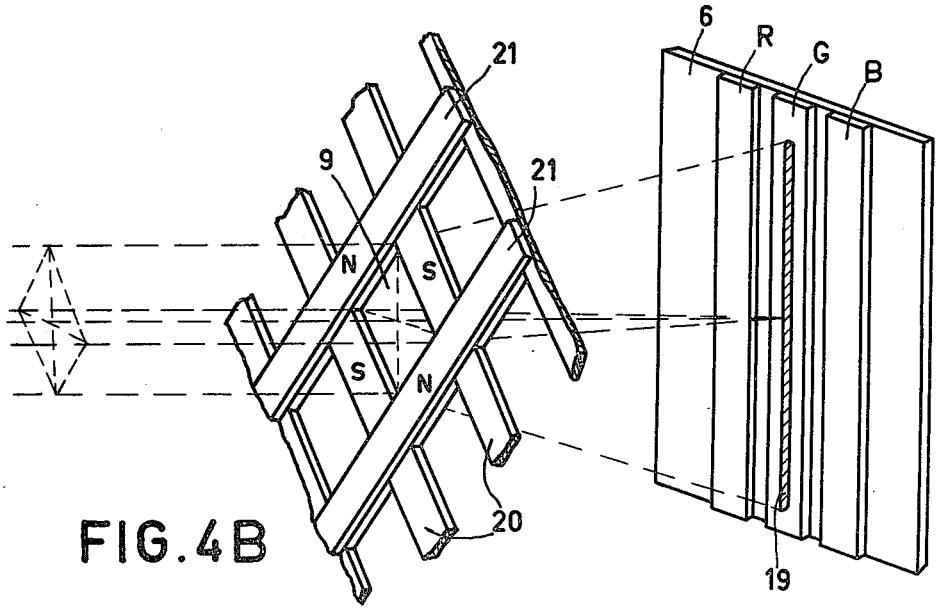

FIG. 4*b* shows diagrammatically the focusing effect of a quadrupole in an aperture 9 of the colour selection means 7 of FIG. 4*a*. The variation of the magnetization along the edge of the aperture 9 is denoted by N, S, N, S. The electron beam which passes through the aperture 9 is focused in the horizontally drawn plane and defocused in the vertically drawn plane. The phosphor lines luminescing in the colours red (R), green (G) and blue (B) are provided on the display screen 6 in a vertical direction, so in the defocusing direction of the quadrupole lens, so that the longitudinal direction of the electron spot 19 coincides with the longitudinal direction of the phosphor lines.

Figure 4C:
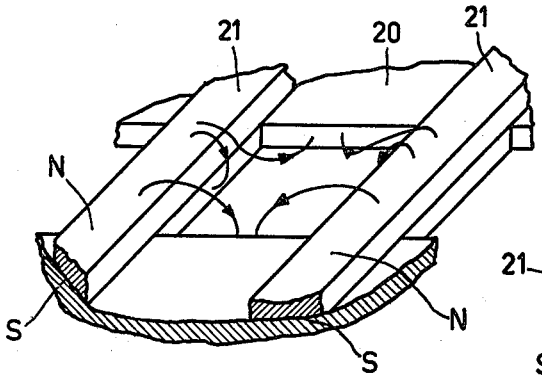
Figure 4D:
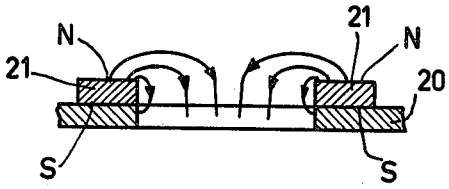

FIGS. 4*c* and 4*d* show diagrammatically the variation of the magnetic field lines in an aperture 9 of the colour selection means 7.

Figure 5A:
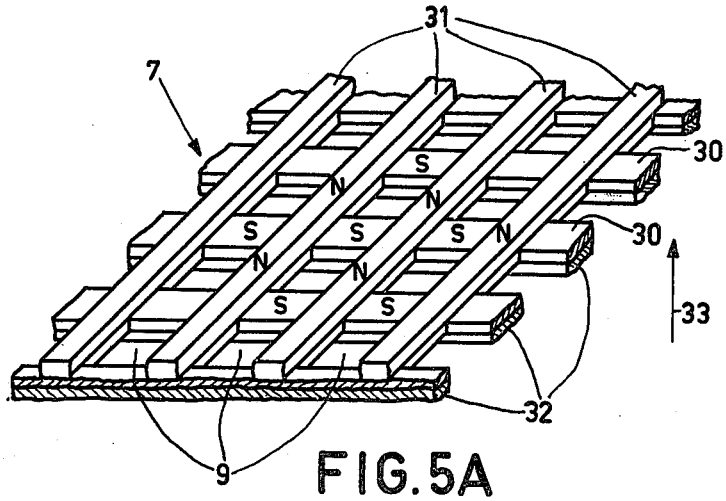
FIGS. 5A, 5B and 5C show another embodiment of the colour selection means of a tube according to the invention.
Figure 5B:
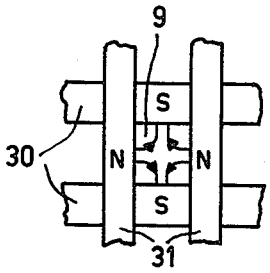
Figure 5C:
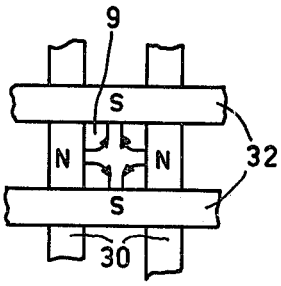

Another embodiment will be described with reference to FIG. 5*a*. The colour selection means 7 are formed by a plate 30 of soft magnetic material having a large number of apertures 9. Parallel strips 31 are provided on one side of the plate 30 and parallel strips 32 are provided on the other side. The strips 31 are substantially perpendicular to the strips 32. The strips 31 and 32 are preferably provided on the plane 30 in the unmagnetized condition, after which the colour selection means are magnetized as a whole by means of a homogeneous magnetic field in a direction perpendicular to the plane of the plate 30. In this manner a magnetic quadrupole is formed in each aperture 9 on both sides of the plate. When the direction of the magnetization field is, for example, equal to the direction of the arrow 33, then the sides of the strips 31 remote from the plate 30 constitute north poles, the plate 30 on the side of the strips 31 serving as a south pole. The sides of the strips 32 remote from the plate 30 constitute south poles and the plate 30 on the side of the strips 31 constitutes a north pole. FIG. 5*b* and FIG. 5*c* show diagrammatically a plan view and an underneath view, respectively, of an aperture 9 of FIG. 5*a*. When an electron beam passes through an aperture 9 in the colour selection means 7 it traverses two quadrupole lenses. In order to obtain substantially the same focal distance in two quadrupole lenses as in the FIG. 4 embodiment having one quadrupole lens, the thickness of the strips 30 and 31 should be approximately equal to half the thickness of the strips 21 of FIG. 4. As a result of the more symmetrical construction of the magnetic system in the FIG. 5 embodiment compared to that of FIG. 4, lens errors are better corrected for so that a better linear spot of an electron beam on the display screen is obtained. If in the FIG. 5 embodiment the plate 30 has a thickness of 15 mm and the apertures are square with dimensions 0.5×0.5 mm, the pitch between the apertures is 1 mm and the strips are manufactured from Ferroxdure 280 and have a thickness of 0.16 mm and a width of 0.20 mm, then the focal distance of the quadrupole lenses is approximately 13 mm with a magnetization field which is sufficiently large for Ferroxdure and an energy of the electron beam of 25 KeV. When the electron beam is not incident perpendicularly, which is the case near the corners of a display screen, the focal distance becomes somewhat smaller. The distance between the colour selection means 7 and the display screen 6 is 9 mm in the centre and 6 mm at the edge of a display window, all this in such manner that the focus of the quadrupole lenses always is slightly beyond the display screen 6 so as to prevent a so-called focus ring from becoming visible. By causing the magnetization to vary over the colour selection means, a large extent of freedom of the distance between the colour selection means 7 and the display screen 6 can be obtained. The colour selection means 7 may also been placed over the shole surface at a constant distance from the display screen 6 if the thickness of the strips of hard magnetic material decreases towards the edge of the display window. In the presently generally used shadow mask tubes the electron beams in the tube are screened from the earth's magnetic field by means of a metal screening cone and the shadow mask which are both manufactured from a soft magnetic material.

In order to obtain an even better magnetic screening of the colour selection means in a tube in accordance with the invention, the sides of the hard magnetic strips remote from the soft magnetic plate in the FIG. 4 and 5 embodiments may be provided with strips of a soft magnetic material, for example iron. As a result of this the lens strength in each of the apertures is also favourably influenced.

A display screen for a tube in accordance with the invention can be manufactured by means of a known exposure method in which the colour selection means are displayed on a photosensitive layer on a window portion of the tube. In connection with the large transmission of the colour selection means in accordance with the invention the exposure method used must be suitable to display the apertures 9 in a strongly narrowed manner. An exposure method suitable for this purpose uses two or more light sources at some distance from each other as described in German patent application No. 2,248,878. Of course, a tube in accordance with the invention is also excellently suitable for so-called electronic exposure in which the sensitive layer on the window portion is "exposed" by means of an electron beam. Exposure may also be carried out with small apertures 9 which, after exposure, are enlarged by after-etching until the desired dimensions have been obtained.

What is claimed is:

1. A cathode ray tube for displaying coloured pictures comprising in an evacuated envelope means to generate a number of electron beams, a display screen comprising a large number of areas luminescing in different colours, and colour selection means comprising a large number of apertures, in which apertures a magnetic quadrupole lens is formed and which apertures assign each electron beam to luminescent areas of one colour, characterized in that the colour selection means are formed by an apertured plate of soft-magnetic material, which plate is provided on one side with a first grid of parallel strips of hard magnetic material provided between the rows of apertures, and which colour selection means are magnetized in a direction perpendicular to the plane of the plate.

2. A cathode ray tube as claimed in claim 1, characterized in that on the side remote from the first grid the plate of soft magnetic material is provided with a second grid of parallel strips of hard magnetic material, the strips of the second grid crossing the strips of the first grid.

3. A cathode ray tube as claimed in claim 1 or 2, characterized in that on the side remote from the plate the strips of hard magnetic material are provided with a layer of soft-magnetic material.

* * * * *